US005566917A

United States Patent [19]

Wu

[11] Patent Number: 5,566,917

[45] Date of Patent: Oct. 22, 1996

[54] RECEPTACLE BRACKET

[76] Inventor: Shin-wang Wu, 19Fl.-2, No. 508, Sec. 5, Chungsiao E. Rd., Taipei, Taiwan

[21] Appl. No.: 525,009

[22] Filed: Sep. 8, 1995

[51] Int. Cl.[6] ..... A47K 1/08

[52] U.S. Cl. ..... 248/311.2; 248/345

[58] Field of Search ..... 248/311.2, 315, 248/309.1, 314, 110, 111, 310, 312.1, 345; 4/605, 559, 628; D6/528, 534, 535

[56] References Cited

U.S. PATENT DOCUMENTS

| | | | |
|---|---|---|---|
| 4,696,447 | 9/1987 | Strecker | 248/309.1 |
| 4,697,780 | 10/1987 | Wenkman et al. | 248/314 |
| 5,279,452 | 1/1984 | Huynh | 248/314 |

*Primary Examiner*—Ramon O. Ramirez
*Assistant Examiner*—Willie W. Berry, Jr.
*Attorney, Agent, or Firm*—Parkhurst, Wendel & Burr, L.L.P.

[57] ABSTRACT

A support bracket for use in a bathroom wherein the support bracket includes a semi-conical cover with an arcuate wall integrally formed with a vertical wall. A trapezoid opening is defined in the vertical wall. A projection with an inclined lower face is integrally formed on an inside face of the vertical wall. An L-shaped support has an upright portion and a perpendicular portion integrally formed therewith wherein a distal tip of the vertical portion is sized and shaped as a trapezoid tongue to matingly engage with the trapezoid opening of the cover and the perpendicular portion has a distal end shaped to receive a receptacle. A semi-circular plate is sized to be fittingly received in a base of the cover with the L-shaped support sandwiched therebetween.

4 Claims, 4 Drawing Sheets

RECEPTACLE BRACKET

FIELD OF THE INVENTION

This invention relates to a receptacle bracket and more particularly, a receptacle bracket for use in a bathroom or kitchen.

BACKGROUND OF THE INVENTION

Receptacle brackets are commonly used in bathrooms for toothbrush mugs, soap dishes etc., to rest thereon. One particular style of receptacle bracket is shown in FIG. 5. Such a receptacle bracket substantially comprises a dovetailed tenon 68, a base 66, a body 64, a decorative ring 62 and a decorative cap 60. The dovetailed tenon 68 is secured to a wall (not shown) by a screw 70 and then a second screw 72 extends respectively through the base 66, the body 64 and the decorative ring 62 to threadedly engage with a boss 61 projecting from the decorative cap 60. The base further defines a dovetail mortise [not numbered] to attachably engage the assembly to the wall via the dovetail tenon 68. A screw 69 extends transversely through a hole in a side of the base 66 to fix further the body 64 thereto.

However, it is found that such a bracket loosens after a period of use and does not provide a secure attachment to the wall whereby articles supported on the bracket may fall to the floor causing inconvenience and possibly breakage.

Thus, there has been a long and unfulfilled need for a receptacle bracket for a bathroom which provides sturdy and effective retention over a long period of time.

SUMMARY OF THE INVENTION

It is the broad object of the present invention to provide a receptacle bracket that incorporates the foregoing features and advantages.

A more specific object of the invention is to provide a receptacle bracket which may be adapted for placement of toothbrush mugs, soap dishes and so on, in a bathroom.

An additional object of the invention is to provide a receptacle bracket which can be securely and fixedly retained to a wall over a long period of time.

Yet another object of the invention is to provide a receptacle bracket which is inexpensive in construction and assembled easily.

It has been found that a certain of the foregoing and related objects are readily obtained by the provision of a receptacle bracket comprising a semi-conical cover, a semi-circular plate and an L-shaped support.

A substantially semi-conical cover has an arcuate wall and a vertical wall integrally formed therewith. A trapezoid opening is centrally defined in the vertical wall by two vertical edges and a horizontal upper edge. A tubular boss extends from an underside of the arcuate wall and has a threaded periphery formed therein.

An L-shaped support has an upright-portion integrally formed with a perpendicular portion. The upright portion has a distal tip substantially shaped and sized as a trapezoid tongue to be fittingly received in the trapezoid opening of the cover. The perpendicular portion, in this embodiment, has an end formed as a ring to receive a receptacle for toothbrushes etc.

A semi-circular plate is sized to be fittingly received in a base of the cover thereby sandwiching the L-shaped support there between.

A bolt extends through a hole defined in the plate to threadedly engage with the tubular boss.

A grub screw extends upwardly through a hole defined near a straight edge of the base to urge against a bottom edge of the trapezoid end of the L-shaped support to provide a locking effect by which the receptacle support will remain securely assembled during use over a long period of time.

A hole is defined through the vertical portion of the L-shaped support and through which a screw may extend to secure the receptacle bracket to the wall.

DESCRIPTION OF THE PREFERRED EMBODIMENT

Figure 1:
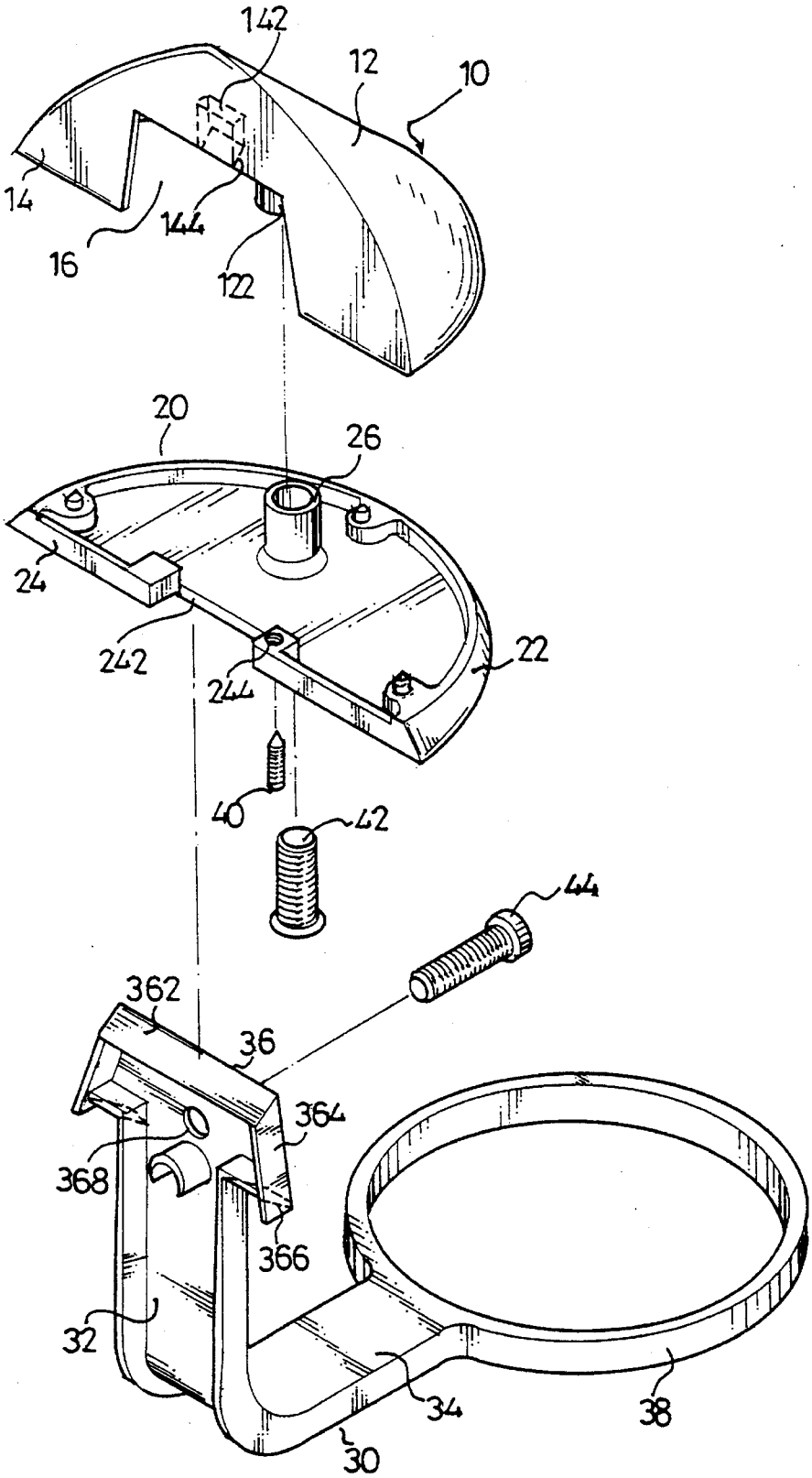
FIG. 1 is a perspective, exploded view of receptacle bracket in accordance with the present invention.

Referring to the drawings and particularly FIG. 1, a substantially semi-conical cover 10 has an arcuate wall 12 and a vertical wall 14 integrally formed therewith. A trapezoid opening 16 is centrally defined in the vertical wall 14 by two vertical edges and a horizontal, upper edge. The vertical edges incline towards each other from bottom to top.

A tubular boss 122 extends downwardly from an underside of the arcuate wall 12 and has a threaded periphery formed therein. A projection 142 with an inclined lower face 144 is integrally formed on an inner side of the vertical wall 14 with a lower edge of the inclined face 144 adjacent and parallel to the horizontal edge.

An L-shaped support 30 has an upright portion 32 integrally formed with a perpendicular portion 34.

The upright portion 32 has a free end substantially shaped and sized as trapezoid tongue 36 to be matingly received in the trapezoid opening 16 of the cover 10. The trapezoid tongue 36 has four inclined faces, a top face 362 two side aces 364 and an interrupted bottom face 366. Each face 362, 364, 366 inclines rearwardly and inwardly.

Figure 4:
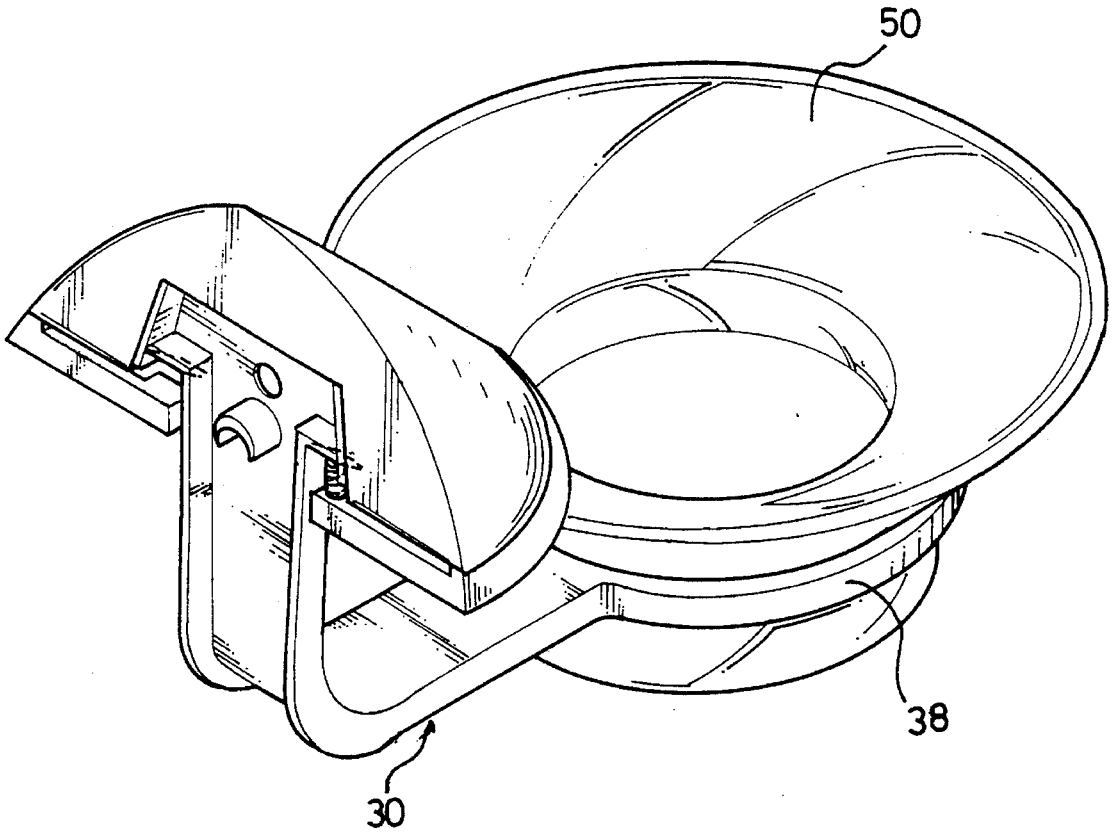
FIG. 4 is perspective of receptacle bracket showing a use thereof.
Figure 5:
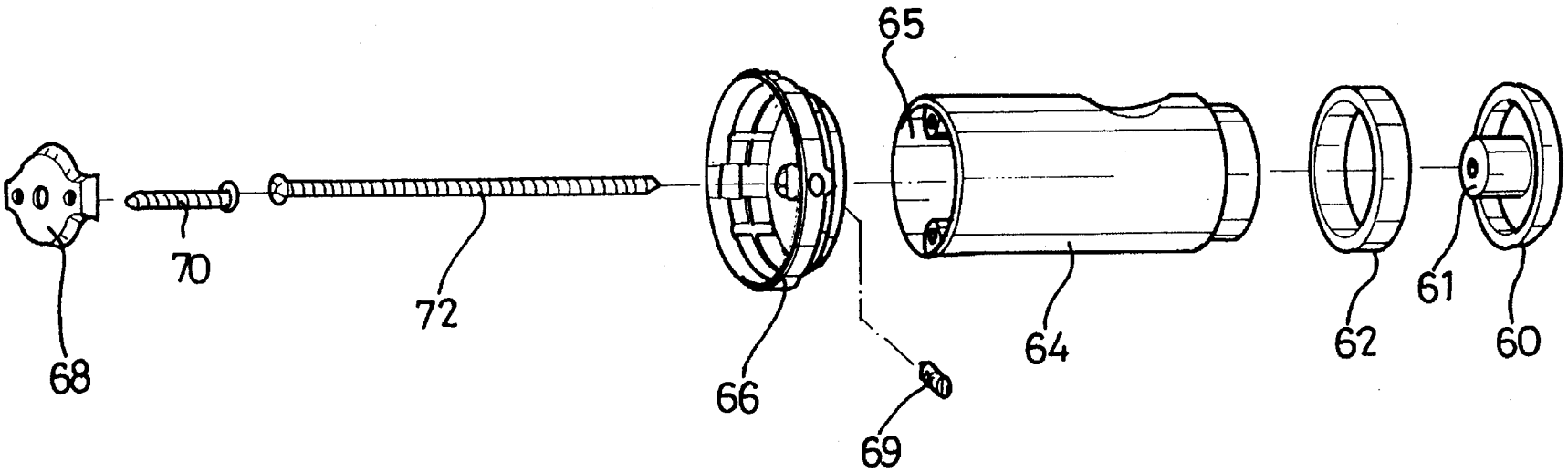
FIG 5 PRIOR ART
FIG. 5 is an exploded view of a prior art receptacle bracket.

The perpendicular portion 34, in this embodiment, is formed as a ring 38 to receive a receptacle (not shown) for toothbrushes etc. A further embodiment as seen in FIG. 4, can receive a soap dish 50. Yet a further embodiment (not shown) is shaped as a hook upon which articles can hang.

A semi-circular plate 20 is sized to be fittingly received in a base of the cover. An arcuate periphery 22 of the plate 20 is inwardly and upwardly inclined.

A straight wall 24 defines an aperture 242 sized to receive a width of the vertical portion 32 of the L-shaped support 30. A hole 244 defined by a threaded periphery extends vertically through the straight wall 24 near one of two blocks (not numbered), each adjacent to the aperture 242. A tubular column 26 extends upwardly from a top side of the plate 20, a passage defined therein extending to a bottom side of the plate 20.

A first fixing means, such as a bolt 42, extends through the tubular column 26 to threadedly engage with the tubular boss 122 of the cover 10.

A second fixing means, such as a grub screw 40 extends upwardly through the hole 244 of the plate 20 to urge against the bottom face 366 of the L-shaped support, thereby providing a secure engagement of the assembly.

The upright portion 32 of the L-shaped support further has a hole 368 defined therethrough, in a center of the trapezoid tongue 36 whereby a third fixing means, such as a wall screw 44, can extend therethrough so that the receptacle bracket may be removably attached to a wall.

Figure 3:
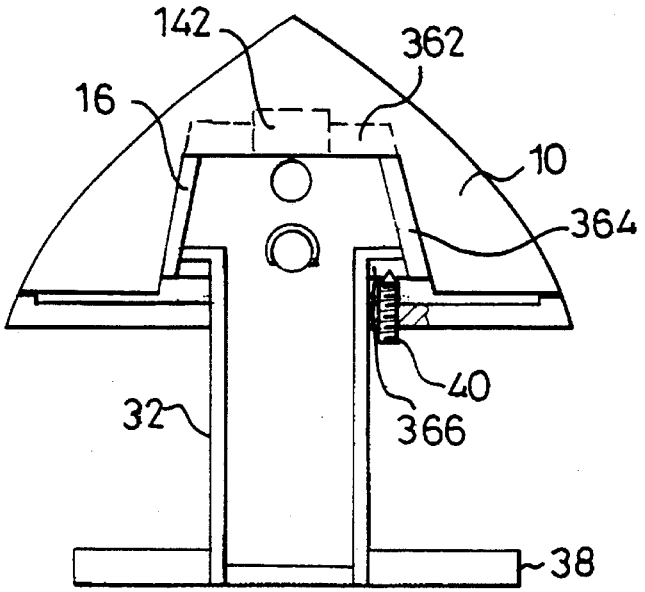
FIG. 3 is an end elevation of the receptacle bracket as shown in FIG. 1.
Figure 2:
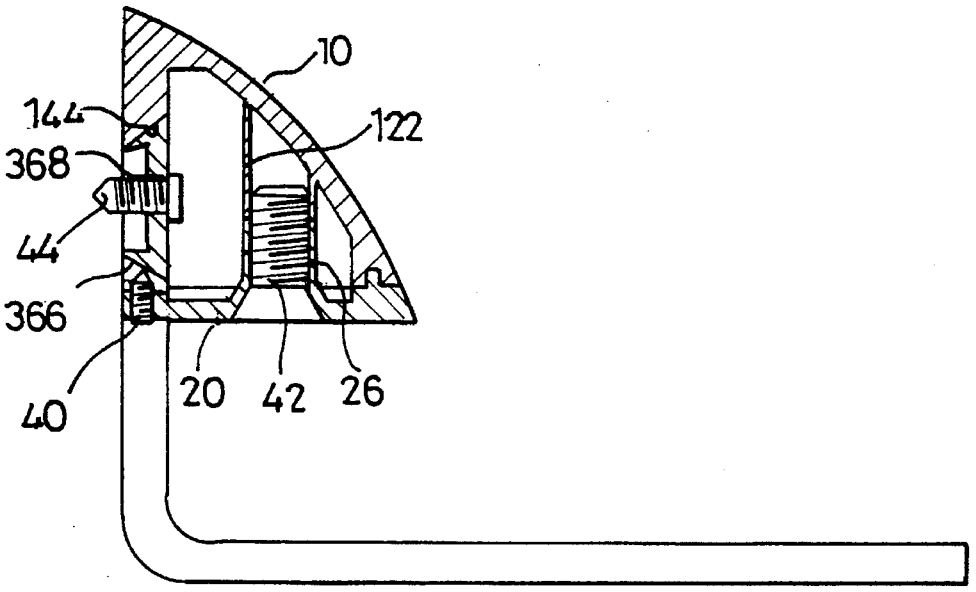
FIG. 2 is a cross-sectional side elevation of the receptacle bracket as shown in FIG. 1.

Referring to FIGS. 2 and 3, in assembly, the cover 10 is fitted to the plate 20.

The trapezoid tongue 36 is matingly fitted in the trapezoid opening 16 until the top inclined edge 144 of the projection 142 abuts the inclined face 362 of the trapezoid tongue 36. The plate 20 is fitted to the upright portion 32 by mating between the aperture 242 and the width of the upright portion 32.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What the invention claimed is:

1. A receptacle bracket to be mounted to a wall, comprising:

a support mounted in a stationary relationship to the wall, the support having an upright portion integrally formed with a perpendicular portion, said upright portion having a tongue defining an upper and a lower inclined surfaces, said perpendicular portion having a free end shaped to receive a receptacle;

a cover having a semi-conical wall and a vertical wall integrally formed therewith, an opening defined in the vertical wall, a projection with an inclined face integrally formed on an inner side of the vertical wall to engage the upper inclined surface;

a semi-circular plate securely mounted to a base of said cover and having a recess, said recess and said opening together matingly receiving the tongue of said upright portion of said support; and means for urging against the lower inclined surface to move the combination of the cover and the plate in a direction toward the wall.

2. The receptacle bracket as claimed in claim 1 wherein:

the means for urging against the lower inclined surface is a grub screw upwardly extending through the semi-circular plate whereby, as the grub screw is extended upwards against the lower inclined surface the combined cover and plate are respondingly urged closer to the wall, thereby providing a firm fit.

3. The receptacle bracket as claimed in claim 1 wherein:

the semi-circular cover has a tubular boss extending downwardly from an underside thereof and having a threaded periphery formed therein; and the semi-circular plate has a tubular column extending upwardly from a top side thereof through which a bolt extends to threadedly engage with the tubular boss thereby clamping the plate to a base of the cover.

4. The receptacle bracket as claimed in claim 1 wherein:

the tongue of the upright portion further defines two side surfaces each inwardly and rearwardly inclined; and the opening in the vertical wall of the cover is defined as a trapezoid to mate with the tongue to prevent a lateral movement between the cover and the support.

* * * * *